US007732947B2

(12) United States Patent
Watanabe et al.

(10) Patent No.: US 7,732,947 B2
(45) Date of Patent: Jun. 8, 2010

(54) POWER UNIT AND IMAGE FORMING SYSTEM

(75) Inventors: Hiroyuki Watanabe, Hachioji (JP); Ryuji Okutomi, Hino (JP); Hideo Yamane, Hachioji (JP); Yoshihito Sasamoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 528 days.

(21) Appl. No.: 11/812,943

(22) Filed: Jun. 22, 2007

(65) Prior Publication Data

US 2008/0031651 A1 Feb. 7, 2008

(30) Foreign Application Priority Data

Aug. 3, 2006 (JP) ..... 2006-212332

(51) Int. Cl.
*H01H 9/54* (2006.01)

(52) U.S. Cl. ..... 307/140; 399/88

(58) Field of Classification Search ..... 307/140
See application file for complete search history.

(56) References Cited

U.S. PATENT DOCUMENTS

2007/0280720 A1* 12/2007 Kimura ..... 399/88

FOREIGN PATENT DOCUMENTS

JP 7-75251 3/1995
JP 2003-250228 9/2003

* cited by examiner

*Primary Examiner*—Robert L. Deberadinis
(74) *Attorney, Agent, or Firm*—Finnegan, Henderson, Farabow, Garrett & Dunner, L.L.P.

(57) ABSTRACT

Present invention uses the main power source and auxiliary power source to supply power to a load, makes them take partial charge of power supply, and when the load current reaches its peak, detects a current and a voltage generated by the auxiliary power source, and when the detected values are larger than set values or lower than the set values, controls the output current of the main power source.

6 Claims, 6 Drawing Sheets

POWER UNIT AND IMAGE FORMING SYSTEM

This application is based on Japanese Patent Application No. 2006-212332 filed on Aug. 3, 2006, in Japanese Patent Office, the entire content of which is hereby incorporated by reference.

BACKGROUND

1. Technical Field

The present invention relates to a power unit having a main power source and an auxiliary power source, particularly using an electric double layer capacitor as an auxiliary power source and an image forming system.

2. Description of the Related Art

When supplying all power to a load having a peak from a main power source such as a battery or a DCPS (DC power supply system), it is necessary to fit the power supply capacity of the main power source to the peak. However, for that purpose, it causes enlargement of the apparatus such as enlarging the output transformer of the DCPS and an increase in cost.

On the other hand, to solve the aforementioned problem, a method for using a combination of an auxiliary power source using an electric double layer capacitor (hereinafter, simply referred to as a capacitor) with the main power source is proposed.

For example, in Japanese Unexamined Patent Application Publication No. 2003-250228, the system which has a power source controller for controlling a current supplied from the main power source between the power source and an energy storage unit having a capacitor, and when the output voltage of the power source lowers, the supply current from the power source is reduced, and insufficient power is covered by the capacitor is proposed.

Further, in Japanese Unexamined Patent Application Publication No. 7-75251, the system which uses a variable impedance such as a thermistor having a positive resistance temperature coefficient between the main power source and the capacitor, and when a large current flows through the load, using an increasing property of the variable impedance value, the current supply from the power source is suppressed, and the current is supplied exclusively from the capacitor is proposed.

However, in such a constitution that the internal impedance of the capacitor used as an auxiliary power source is higher than the internal impedance of the main power source, the capacitor cannot function sufficiently as an auxiliary power source.

This problem will be explained below.

In the capacitor, the internal impedance per cell is generally low, though the dielectric strength is low such as 2.5 V, so that when using the capacitor as an auxiliary power source as indicated in the above example, the dielectric strength must be increased, thus it is necessary to connect a plurality of capacitors in series. By doing this, for example, if 10 capacitors having an internal impedance of 100 mΩ of a cell having a dielectric strength of 2.5 V are connected in series, the dielectric strength is increased to 25 V/internal impedance of 1Ω.

On the other hand, in a nickel-hydrogen cell as a main power source, the internal impedance per cell (1.2 V) is 5 mΩ or so and when 21 cells are connected in series to obtain 25 V, the internal impedance becomes about 100 mΩ. On the other hand, when a DCPS is used as a main power source, the impedance thereof becomes about several tens mΩ to several hundreds mΩ.

Therefore, the internal impedance of the auxiliary power source may be higher than the internal impedance of the main power source.

When the internal impedance of the auxiliary power source becomes higher than the internal impedance of the main power source like this, at time of the peak load current, the current to be supplied originally from the auxiliary power source, since the internal impedance is high, is supplied almost from the main power source and a problem arises that the auxiliary power source does not fulfill its original function as an auxiliary power source. And, as a result, the charging energy of the capacitor cannot be used.

Furthermore, when supplying the current from the capacitor, a voltage drop due to the internal impedance occurs, so that another problem arises that the lowest operation voltage on the load side cannot be kept.

The present invention is proposed to solve the aforementioned problem and is intended to provide a power unit combined with a main power source and an auxiliary power source composed of an electric double layer capacitor for fulfilling the function of the auxiliary power source, using the charging energy stored in the capacitor, and furthermore maintaining the lowest operation voltage on the load side and an image forming system.

SUMMARY

One aspect of the invention is a power unit including a main power source and an auxiliary power source having an electric double layer capacitor, wherein the power unit supplies power to a load and the power supplied to the load is shared by the main power source and the auxiliary power source, the power unit comprising: an output detection section for detecting an output of the auxiliary power source; and a power control section adapted to control an output current of the main power source based on a detection output of the output detection section.

Another aspect of the invention is a power unit including a main power source and an auxiliary power source having an electric double layer capacitor, wherein the power unit supplies power to a load and the power supplied to the load is shared by the main power source and the auxiliary power source, the power unit comprising: a current detection section for detecting an output current of the auxiliary power source; a voltage detection section for detecting an output voltage of the auxiliary power source; a current detection processing unit adapted to compare the output of the current detection section with a predetermined current value and to output a control signal for decreasing or increasing the output current of the main power source according to a difference from the set value; a voltage detection processing unit adapted to compare the output of the voltage detection section with a predetermined voltage value and when the detected output voltage value is lower than the predetermined voltage value, and to output a control signal for increasing the output current of the main power source; a power control section having a switching section for switching between the output of the current detection processing unit and the output of the voltage detection processing unit; and an input section for supplying a switching signal to the switching section.

DESCRIPTION OF THE PREFERRED EMBODIMENT

Hereinafter, the embodiment of the present invention will be explained.

Figure 1:
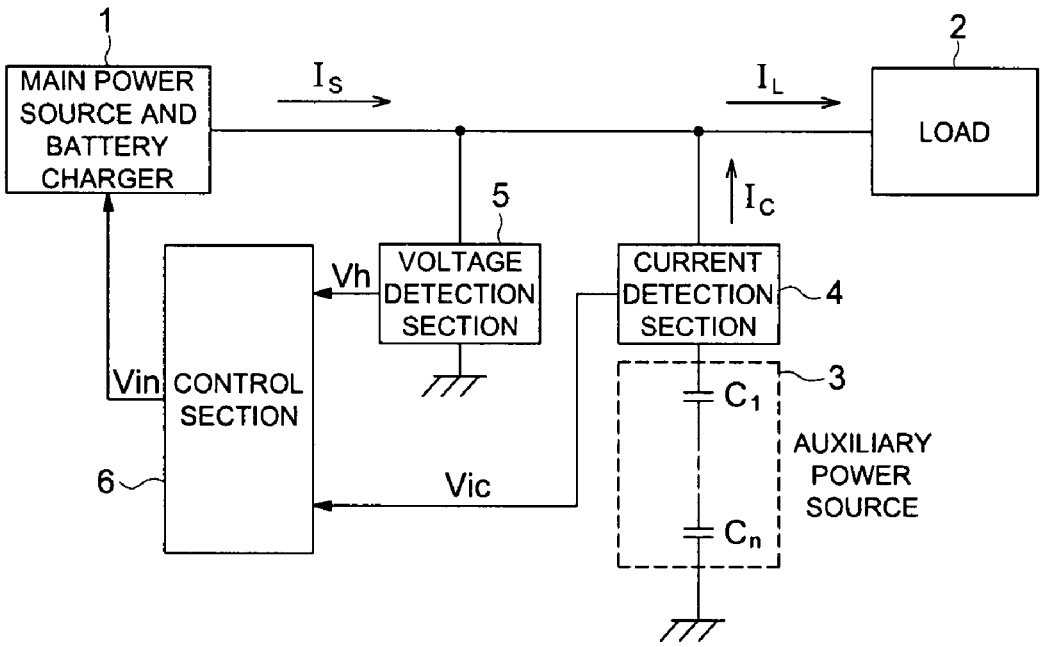
FIG. 1 is a schematic block diagram of the power unit.

FIG. 1 is a schematic block diagram of the present invention.

Numeral 1 indicates a main power source and concurrently charger (hereinafter, referred to as a main power source), which is composed of an AC-DC converter, or a DC-DC converter, or a storage battery.

Numeral 2 indicates a load, which is supplied with power from the main power source 1 and is driven.

Numeral 3 indicates an auxiliary power source, which is composed of a plurality of capacitors C1 to Cn connected in series and assists power supply from the main power source 1 to the load 2.

The main power source 1 and load 2 are connected directly to each other and the auxiliary power source 3, via a current detection section 4 for detecting the current supplied from the auxiliary power source, is connected to the connection route between the main power source 1 and the load 2. Further, between the connection route of the main power source 1 with the load 2 and the connection terminal, a voltage detection section 5 for detecting the output voltage of the auxiliary power source, that is, the voltage impressed to the load 2 is connected.

Numeral 6 indicates a control section, which is related to a current Ic supplied from the auxiliary power source, inputs an output Vic of the current detection section 4 and an output Vh of the voltage detection section 5, and transmits a control signal Vin for the main power source 1. The control section 6 functions as a power control section to control an output current of the main power source.

Here, the power unit to which the present invention is applied is preferably set under the specification satisfying the following relationship.

$$Zm \leqq Zc$$

where Zm is an internal impedance of the main power source and Zc is an internal impedance of the auxiliary power source; and $$Is \geqq ILpeak-(\Delta VCAP-\Delta VL)/Zc$$

where Is (A) is an output current of the main power source, ILpeak (A) is the peak current of the load, ΔVCAP (V) is a voltage drop allowable width of the auxiliary power source and ΔVL (V) is a voltage drop width per cycle of the load current due to power supply from the auxiliary power source to the load.

Figure 2:
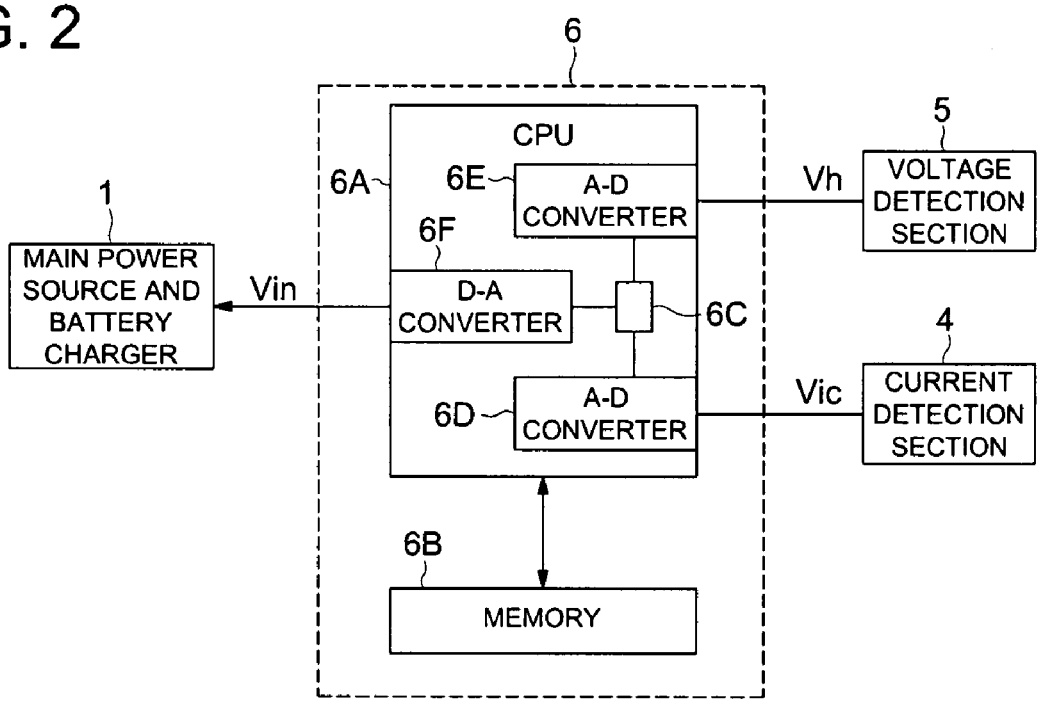
FIG. 2 is a concrete block diagram of the control section shown in the above block diagram.

FIG. 2 shows an example of the control section 6 composed of software. Namely, a CPU (central processor unit) 6A and a memory 6B composed of a ROM (read only memory) and a RAM (random access memory) are installed. And, the CPU 6A is equipped with an A-D converter 6D for converting the output Vic of the current detection section 4 to a digital signal, an A-D converter 6E for converting the output Vh of the voltage detection section 5 to a digital signal, a calculation unit 6C for receiving the digital signals from the A-D converters 6D and 6E, comparing them with set reference values, and calculating the differences, and a D-A converter 6F for converting the calculation result signals from the calculation unit 6C to analog signals.

Further, in the ROM of the memory 6B, the programs according to the flow charts shown in FIGS. 5 and 6 which will be described later are stored.

Figure 3:
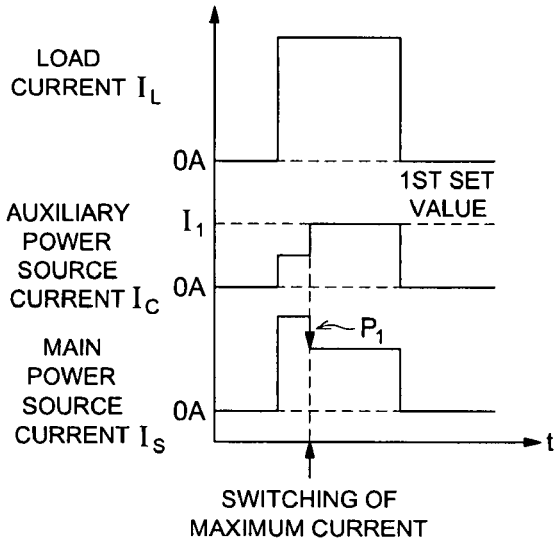
FIGS. 3(A) and 3(B) are time charts for explaining the current detection control operation.
Figure 3:
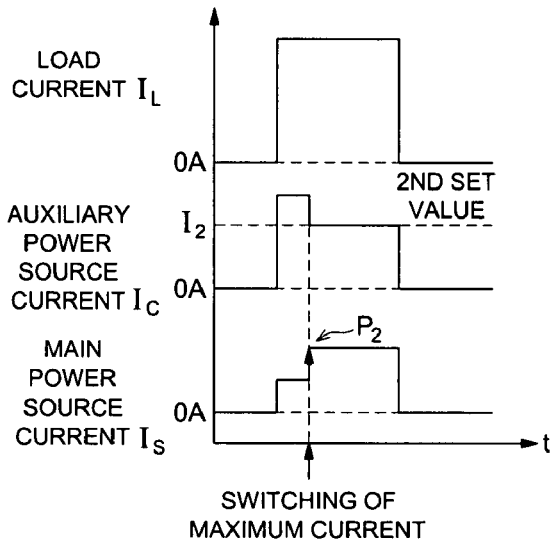

Next, the operation of the present invention will be explained by referring to the time charts shown in FIGS. 3(A), 3(B), and 4 and the flow charts shown in FIGS. 5 and 6.

Figure 4:
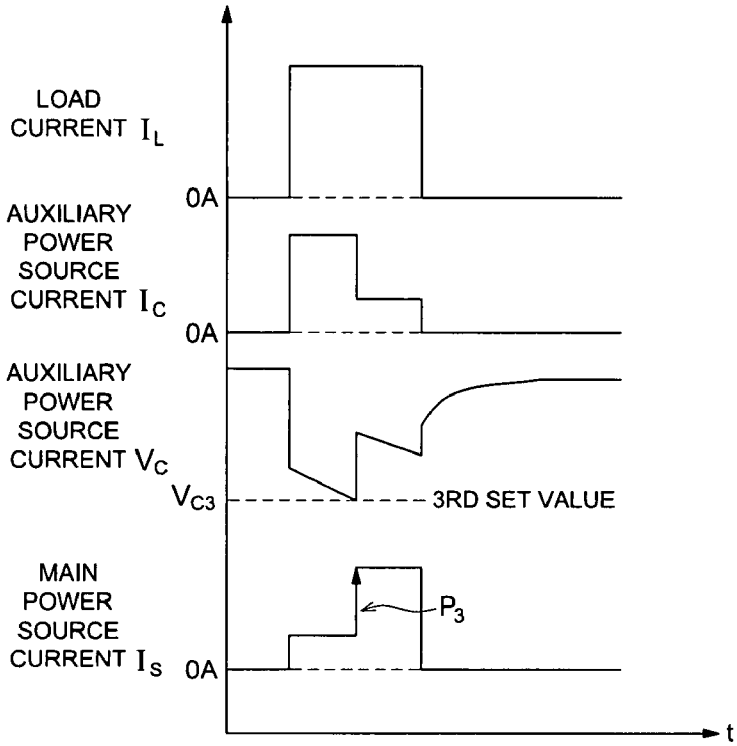
FIG. 4 is a time chart for explaining the voltage detection control operation.

Here, prior to the operation explanation, the time charts shown in FIGS. 3(A), 3(B), and 4 will be outlined.

In FIG. 3(A), the axis of ordinate indicates a load current IL, an auxiliary power source current Ic, and a main power source current Is, and the axis of abscissa indicates time, and a current I1 indicated by a dotted line is assumed as a first set value of the present invention. The first set value, when supplying a current to the load, is a current shared by the auxiliary power source, and in other words, is used to suppress a large current to be shared by the main power source.

FIG. 3(B) has the same arrangement as that shown in FIG. 3(A) and a current I2 indicated by a dotted line is assumed as a second set value. The second set value, since more currents than assumption are supplied from the auxiliary power source due to variations in the internal impedance of the capacitor, is used to prevent earlier discharge and in other words, to suppress the maximum current to be shared by the auxiliary power source and make the main power source share the amount corresponding to it.

In FIG. 4, the axis of ordinate indicates the load current IL, auxiliary power source current Ic, auxiliary power source voltage Vc, and main power source current Is, and the axis of abscissa indicates time, and a voltage Vc3 indicated by a dotted line is assumed as a third set value. The third set value, in correspondence with current supply from the auxiliary power source, is used to suppress the voltage drop amount caused by the internal impedance thereof and in other words, to make the main power source and auxiliary power source properly share the current to be supplied to the load and suppress the voltage impressed to the load.

(Current Detection Operation)

Firstly, the current detection control operation mainly drawn in FIG. 5 will be explained.

In the following operation explanation, it is assumed that the maximum current supplied from the main power source 1 which is a constant current source is variable from 1 A to 5 A and the initial value thereof is 3 A.

Firstly, as initial setting, the reference value I1 (first set value) and I2 (second set value) of the power source supplied from the auxiliary power source 3 and the maximum current Is (3 A in this case) supplied from the main power source are set (Step S1).

Next, the current detection section 4 judges whether the load 2 is on or off (Step S2).

When the load 2 is on and power is supplied to the load, next, the current detection section 4 detects the current Ic of the auxiliary power source 3 and inputs the detection results to the control section 6.

The control section 6 compares the detected current Ic with the set value I1, judges whether Ic is smaller than I1 or not (Step S3), when there is a relationship of Ic<I1, then calculates the difference (I1−Ic=ΔI) between the first set value I1 and Ic, sets a new set value (Is'=Is−ΔI), and reduces the output current Is of the main power source (namely, controls so as to increase the burden of the auxiliary power source) (Step S4).

Next, the control section 6 judges whether the new output current Is' of the main power source set as mentioned above is lower than the lower limit of the variable range (for example, 1 A) or not (Step S5) and when it is lower than the lower limit, controls so as to change it to the lower limit value (1 A) (Step S6). Here, when it is not lower than the lower limit value, the control section 6 maintains the new set value (Step S7).

At Step S3, when it is judged that the auxiliary power source current Ic is not smaller than the set value I1, then the control section 6 judges whether it (Ic) is larger than the second set value I2 (Ic>I2) or not (Step S9).

And, when Ic>I2 is judged, the control section 6 calculates the difference (ΔI=Ic−I2), controls by a new set value (Is'=Is+ΔI) based on it, thereby increases the main power source current, and lightens the burden of the auxiliary power source (Step S10). The control section 6 judges whether the new current Is' of the main power source set like this is larger than the upper limit (for example, 5 A) of the variable range of the main power source or not (Step S11), when the new current Is' is larger than 5 A, controls so as to change it to 5 A (Step S12), and when it is not larger than 5 A, maintains the new set current (Step S13).

Finally, the control section 6 judges whether the load 2 is turned off or not, and when it is not turned off, returns to the first flow, and when it is turned off, finishes the process (Step S8).

(Voltage Detection Operation)

Next, by referring to the flow chart shown in FIG. 6, the voltage detection control operation will be explained.

On the assumption of the following operation explanation, it is assumed that the maximum current supplied from the main power source is variable from 1 A to 5 A and a current instruction to the main power source is in increments of 0.5 A.

Firstly, initial setting is executed. Namely, the third set value Vc3 is set as a reference value of the auxiliary power source voltage and the initial value of the maximum current supplied from the main power source is set to 3 A (Step S21). Next, whether the load is on or off is judged and when it is on, the process goes to the next step (Step S22).

The voltage detection section 5 detects the voltage Vh of the auxiliary power source, judges whether it is smaller than the third set value Vc3 or not (Step S23), and when Vh<Vc3, sets the new output current Is' of the main power source. In this case, the current increases in each 0.5 A (Step S24). In this way, the burden of the main power source is increased and the burden of the auxiliary power source is lightened.

And, the voltage detection section 5 judges whether the new set current Is' is higher than 5 A or not (Step S25), and when it is higher, resets it to 5 A (Step S26), and when it is not higher, maintains the new set value (Step S27). Finally, the voltage detection section 5 judges whether the load is turned off or not, and when it is not turned off, returns to the first flow, and when it is turned off, finishes the process (Step S28).

Next, by referring to FIG. 7, the power unit of the present invention composed of hardware will be explained.

Figure 7:
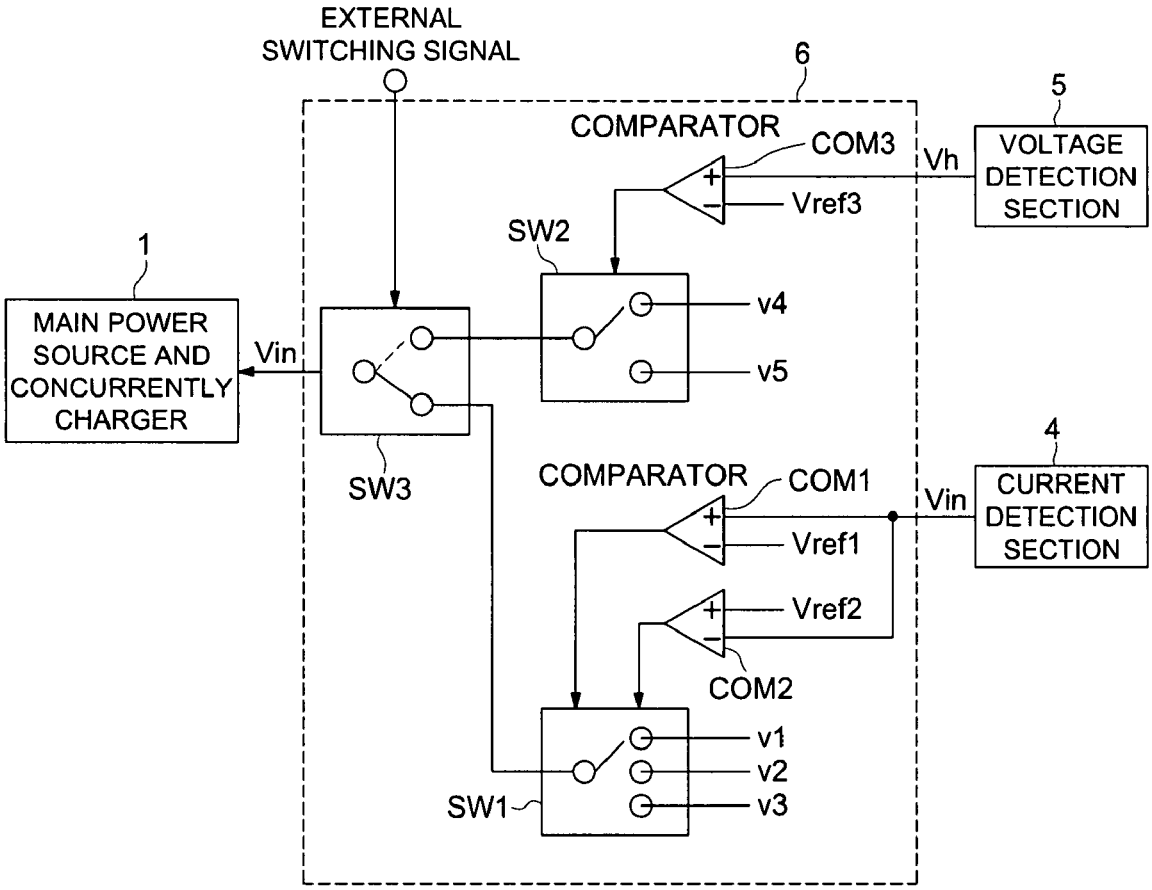
FIG. 7 is a block diagram showing the hardware constitution of the control section.

A concrete configuration example of the control section 6 is shown in FIG. 7.

The control section 6 is composed of a first comparator COM1 for inputting the output Vic of the current detection section 4 to the + side terminal and inputting a first set value Vref1 which corresponds to a first predetermined value to the inversion side terminal, a second comparator COM2 for inputting the output Vic to the inversion side input terminal and inputting a second set value Vref2 which corresponds to a second predetermined value to the + side terminal, a first change-over switch SW1 for switching three steps of voltages V1, V2, and V3 by the outputs of the first and second comparators COM1 and COM2, a third comparator COM3 for inputting the output Vh of the voltage detection section 5 to the + side input terminal and inputting a third set value Vref3 which correspond to a third predetermined value to the inversion input terminal, a second change-over switch SW2 for switching to either of two steps of voltages V4 and V5 by the output of the third comparator COM3, and a third change-over switch SW3 for switching either of the outputs of the first and second change-over switches on the basis of an external switching signal.

Here, the external switching signal aforementioned switches either of the case that it detects the output current of the auxiliary power source 3 and as a result of this, controls the maximum output current of the main power source (the current detection control route) and the case that it detects the output voltage of the auxiliary power source and as a result of this, controls the maximum output current of the main power source (the voltage detection control route) and the cases can be selected optionally.

The operation of the control section 6 for performing the aforementioned operation will be explained by referring again to FIGS. 3 and 4.

(Current Detection Operation)

Firstly, the process for a signal from the current detection section 4 shown on the lower part of FIG. 7 will be explained. In this case, the external switching signal switches the third switching section SW3 to the side of the first switching section SW1.

The output Vic by the current detection section 4 is inputted to the control section 6, is inputted to the plus side input terminal of the first comparator COM1 and the inversion side input terminal of the second comparator COM2, and is compared with the set reference voltage. Here, the set reference value Vref1 of the first comparator COM1 is structured so as to correspond to the first set current I1 shown in FIGS. 3(A) and 3(B) and the set reference value Vref2 of the second comparator COM2 is structured so as to correspond to the second set current I2 shown in FIG. 3(B).

And, the output of comparison results of the first and second comparators COM1 and COM2 is inputted to the first switching section SW1 and switches the switch terminal.

The first switch SW1 is equipped with terminals from the three kinds of voltage sources of V1, V2, and V3 (a relationship of V1<V2<V3 is held), and the terminals are switched on the basis of the output signals of the first and second comparators COM1 and COM2, thus the output signals are outputted. Generally, the first switch SW1 is connected to the central V2 terminal.

For example, when the output Vic from the current detection section 4 is lower than the reference voltage Vref1 of the first comparator COM1, a switching control signal is outputted from the comparator COM1 and functions so as to switch the switching terminal of the switching section SW1 from V2 to V1. As mentioned above, the output of the first switching section SW1 switched to the side of voltage V1 which is lower than the set voltage under normal conditions is inputted to the main power source 1 as a voltage Vin via the third switching section SW3 and controls so as to reduce the output current Is of the main power source. By doing this, the concerned output functions so as to increase the burden of the auxiliary power source.

On the other hand, when the output Vic from the current detection section 4 is higher than the set reference voltage Vref2 of the second comparator COM2, a switching control signal is outputted from the comparator COM2 and on the basis of it, the switching terminal of the first switching section SW1 is switched to the side of the high voltage terminal V3 of the first switching section SW1, and when the switching control signal is inputted as an input voltage Vin to the main power source 1 via the third switching section SW3, it functions so as to increase the output current Is of the main power source and lighten the burden of the auxiliary power source.

(Voltage Detection Operation)

Next, the process of the output from the voltage detection section arranged on the upper part of FIG. 7 will be explained. In this case, the third switching section SW3 is switched to the side of the second switching section SW2 by the external switching signal.

When the output Vh of the voltage detection section 5 is lower than the set reference voltage Vref3 (corresponding to the third set value shown in FIG. 4) of the third comparator COM3, on the basis of the output, the set voltage terminal of the second switching section SW2 is switched from V4 to V5 (V4<V5) and the output Vh is sent to the main power source 1 as a control voltage Vin via the third switching section SW3. As a result, the output current Is of the main power is controlled so as to increase and the burden of the auxiliary power source is lightened.

As mentioned above, the current supplied to the load is shared and controlled by the main power source and auxiliary power source.

Further, the control by current detection and the control by voltage detection are selected by an external switching signal for switching the third switching section SW3, though it is preferable to optionally switch this selection standard, for example, in an operation environment that the load periodically reaches the peak, so as to select the current detection control and in an environment that a case that the load instantaneously reaches the peak (when an instantaneous current flows) is apt to occur, so as to select the voltage detection control.

Figure 8:
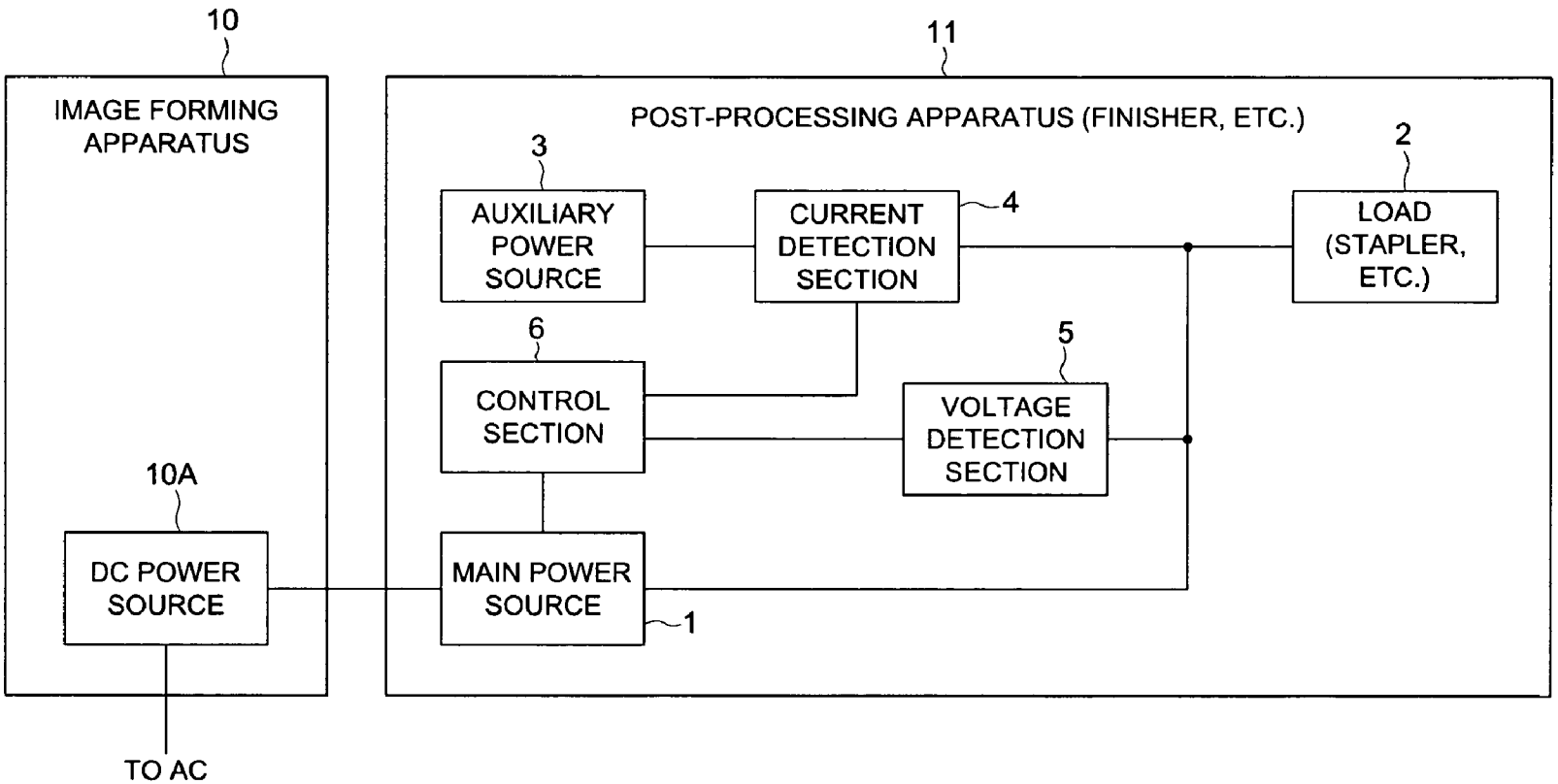
FIG. 8 is a block diagram showing an image forming system having the incorporated power unit of the present invention.

FIG. 8 shows an image forming system having the aforementioned power unit.

As shown in the drawing, an image forming apparatus 10 having a DC power source 10A is combined with a post-processing apparatus (for example, a finisher) 11 and to the post-processing apparatus 11, a connection configuration of the main power source 1, auxiliary power source 3, control section 6, and load 2 is applied.

Figure 5:
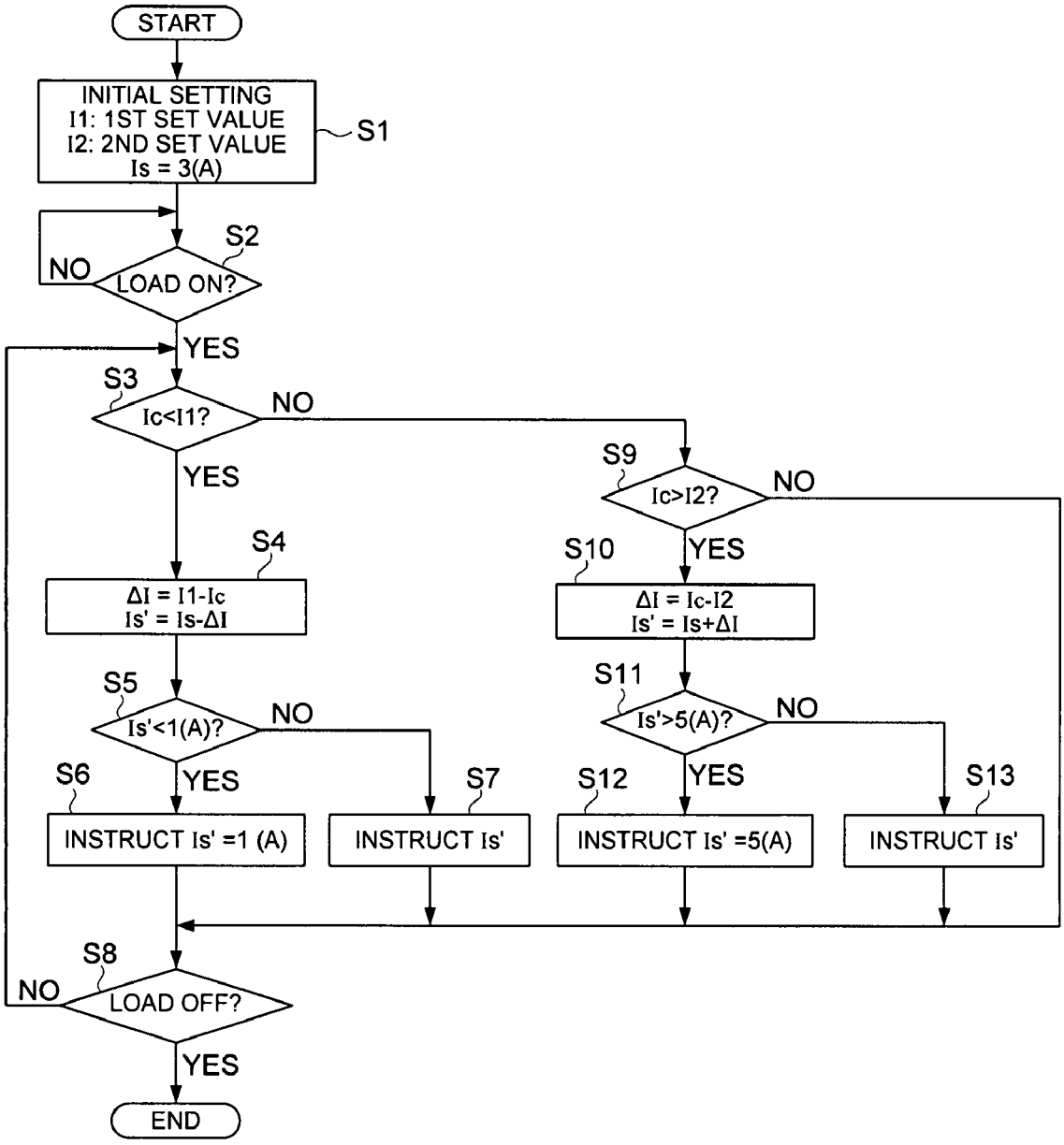
FIG. 5 is a flow chart for explaining the current detection control operation.
Figure 6:
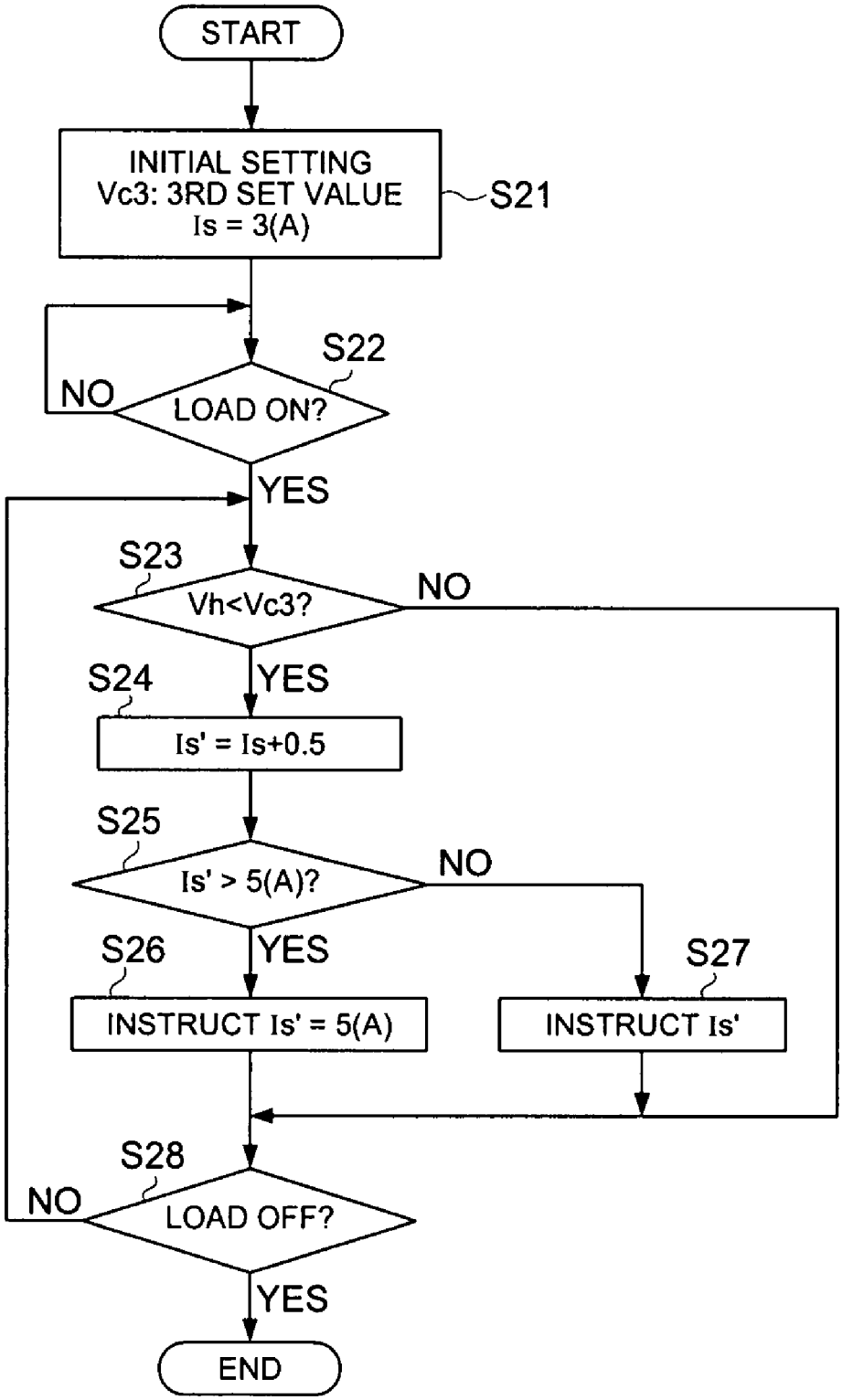
FIG. 6 is a flow chart for explaining the voltage detection control operation.

And, in such a system, the power unit performs the operations shown in the flow charts in FIGS. 5 and 6, and the main power source and auxiliary power source execute appropriate power supply and distribution, thus an image forming system for performing and image forming operation in an operation environment that the main power source will not be overloaded is provided.

What is claimed is:

1. A power unit including a main power source and an auxiliary power source having an electric double layer capacitor, wherein the power unit supplies power to a load and the power supplied to the load is shared by the main power source and the auxiliary power source, the power unit comprising:

an output detection section for detecting an output of the auxiliary power source; and a power control section adapted to control an output current of the main power source based on a detection output of the output detection section.

2. The power unit according to claim 1, wherein the output detection section includes a current detection device which detects an output current of the auxiliary power source and the power control section controls the output of the main power source so as to decrease when a detected output value is lower than a first predetermined value and to increase when a detected output value is higher than a second predetermined value.

3. The power unit according to claim 1, wherein the output detection section includes a voltage detection device which detects an output voltage of the auxiliary power source and the power control section controls the output of the main power source so as to increase when a detected output value is lower than a third predetermined value.

4. The power unit according to claim 1, wherein the power unit satisfies the following conditions:

$$Zm \leqq Zc$$

where Zm is an internal impedance of the main power source and Zc is an internal impedance of the auxiliary power source; and $$Is \geqq ILpeak-(\Delta VCAP-\Delta VL)/Zc$$

where Is (A) is an output current of the main power source, ILpeak (A) is the peak current of the load, ΔVCAP (V) is a voltage drop allowable width of the auxiliary power source and ΔVL (V) is a voltage drop width per cycle of the load current due to power supply from the auxiliary power source to the load.

5. An image forming system, comprising an image forming apparatus and a post-processing apparatus including the power unit of claim 1 therein.

6. A power unit including a main power source and an auxiliary power source having an electric double layer capacitor, wherein the power unit supplies power to a load and the power supplied to the load is shared by the main power source and the auxiliary power source, the power unit comprising:

a current detection section for detecting an output current of the auxiliary power source;

a voltage detection section for detecting an output voltage of the auxiliary power source;

a current detection processing unit adapted to compare the output of the current detection section with a predetermined current value and to output a control signal for decreasing or increasing the output current of the main power source according to a difference from the set value;

a voltage detection processing unit adapted to compare the output of the voltage detection section with a predetermined voltage value and when the detected output voltage value is lower than the predetermined voltage value, and to output a control signal for increasing the output current of the main power source;

a power control section having a switching section for switching between the output of the current detection processing unit and the output of the voltage detection processing unit; and an input section for supplying a switching signal to the switching section.

* * * * *